US007023450B1

(12) United States Patent
Weitbruch et al.

(10) Patent No.: US 7,023,450 B1
(45) Date of Patent: Apr. 4, 2006

(54) DATA PROCESSING METHOD AND APPARATUS FOR A DISPLAY DEVICE

(75) Inventors: Sébastien Weitbruch, Mönchweiler (DE); Carlos Correa, Villingen-Schwenningen (DE); Rainer Zwing, Villigen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 503 days.

(21) Appl. No.: 10/089,361

(22) PCT Filed: Sep. 27, 2000

(86) PCT No.: PCT/EP00/09452

§ 371 (c)(1),
(2), (4) Date: Mar. 26, 2002

(87) PCT Pub. No.: WO01/24152

PCT Pub. Date: Apr. 5, 2001

(30) Foreign Application Priority Data

Sep. 29, 1999 (EP) ..... 99250346

(51) Int. Cl.
*G09G 5/02* (2006.01)

(52) U.S. Cl. ..... 345/593; 345/589

(58) Field of Classification Search ..... 345/58, 345/60, 63, 428, 581, 589, 590, 592, 593, 345/594, 204, 690
See application file for complete search history.

(56) References Cited

U.S. PATENT DOCUMENTS 6,348,930 B1 * 2/2002 Kobayashi et al. ..... 345/672
6,473,464 B1 * 10/2002 Weitbruch et al. ..... 375/240.26
6,501,446 B1 * 12/2002 De Haan et al. ..... 345/63
6,525,702 B1 * 2/2003 Van Dijk ..... 345/63

FOREIGN PATENT DOCUMENTS

| | | |
|---|---|---|
| EP | 0720139 | 7/1996 |
| EP | 0840274 | 5/1998 |
| EP | 0893916 | 1/1999 |

* cited by examiner

*Primary Examiner*—Kent Chang
(74) *Attorney, Agent, or Firm*—Joseph S. Tripoli; Harvey D. Fried; Sammy S. Henig

(57) ABSTRACT

With the new plasma display panel technology new kinds of artefacts can occur in video pictures due to the principle that brightness control is done with a modulation of small lighting pulses in a number of periods called sub-fields. These artefacts are commonly described as 'dynamic false contour effect'. To compensate for this effect motion estimators are used and with the resulting motion vectors corrected sub-field code words are calculated for the critical pixels. Today's motion estimators work with the luminance signal component of the pixels. This is not sufficient for plasma displays. It is therefore proposed to make the motion vector calculation separately for the color components and with either the sub-field code words as data input or with single bit data input for performing motion estimation separately for single sub-fields or for a sub-group of bits from the sub-field code words. The proposal also concerns apparatuses for performing the inventive method.

15 Claims, 12 Drawing Sheets

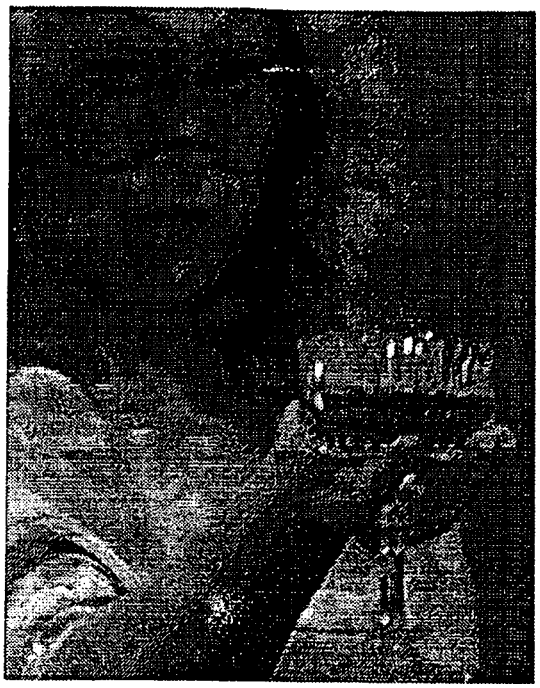
Fig. 1
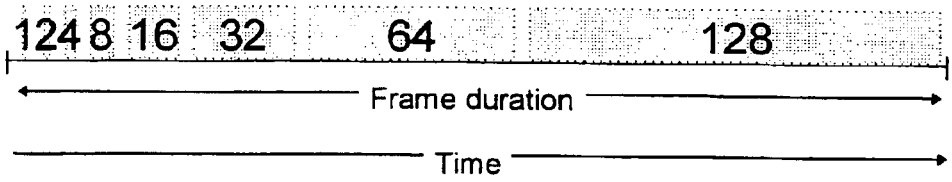
Fig. 2
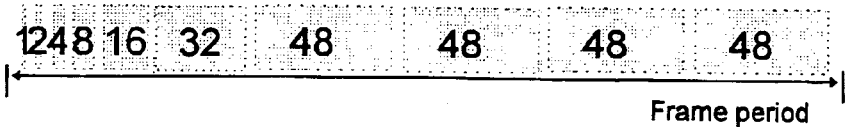
Fig. 3
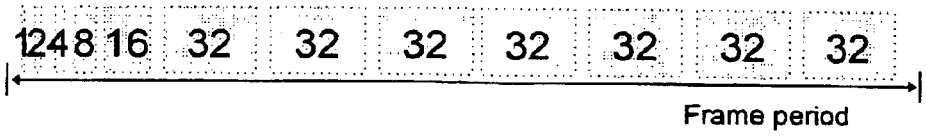

DATA PROCESSING METHOD AND APPARATUS FOR A DISPLAY DEVICE

This application claims the benefit, under 35 U.S.C. § 365 of International Application PCT/EP00/09452, filed Sep. 27, 2000, which was published in accordance with PCT Article 21(2) on Apr. 5, 2001 in English and which claims the benefit of European patent application No. 99250346.6 filed Sep. 29, 1999.

The invention relates to a method and apparatus for processing video pictures for display on a display device. More specifically the invention is closely related to a kind of video processing for improving the picture quality of pictures which are displayed on matrix displays like plasma display panels (PDP) or other display devices where the pixel values control the generation of a corresponding number of small lighting pulses on the display.

BACKGROUND

The Plasma technology now makes it possible to achieve flat colour panel of large size (out of the CRT limitations) and with very limited depth without any viewing angle constraints.

Referring to the last generation of European TV, a lot of work has been made to improve its picture quality. Consequently, a new technology like the Plasma one has to provide a picture quality as good or better than standard TV technology. On one hand, the Plasma technology gives the possibility of "unlimited" screen size, of attractive thickness, etc. But on the other hand, it generates new kinds of artefacts, which could reduce the picture quality.

Most of these artefacts are different as for TV pictures and that makes them more visible since people are used to seeing old TV artefacts unconsciously.

The artefact, which will be presented here, is called "dynamic false contour effect" since it corresponds to disturbances of grey levels and colours in the form of an apparition of coloured edges in the picture when an observation point on the PDP screen moves. The degradation is enhanced when the image has a smooth gradation like a skin. This effect leads to a serious degradation of the picture sharpness, too.

FIG. 1 shows the simulation of such a false contour effect on a natural scene with skin areas. On the arm of the displayed woman are shown two dark lines, which e.g. are caused by this false contour effect. Also in the face of the woman such dark lines occur on the right side.

In addition, the same problem occurs on static images when observers are shaking their heads and that leads to the conclusion that such a failure depends on the human visual perception and happens on the retina.

Some algorithms are known today, which are based on motion estimation in video pictures in order to be able to anticipate the motion of the critical observation points to reduce or suppress this false contour effect. In most cases, these different algorithms are focused on the sub-field coding part without giving detailed information concerning the motion estimators used.

In the past, the motion estimator evolution was mainly focused on flicker-reduction for European TV pictures (e.g. with 50 Hz to 100 Hz upconversion), for proscan conversion, for motion compensated picture encoding like MPEG-encoding and so one. For that purpose, these algorithms are working mainly on luminance information and above all only on video level information. Nevertheless, the problems that have to be solved for such applications are different from the PDP dynamic false contour issue, since the problems are directly linked to the way the video information is encoded in plasma displays.

A lot of solutions have been published concerning the reduction of the PDP false contour effect based on the use of a motion estimator. However, such publications do not mention the topic of motion estimators and especially its adaptation to specific plasma requirements.

A Plasma Display Panel (PDP) utilizes a matrix array of discharge cells that could only be "ON" or "OFF". Also unlike a CRT or LCD in which grey levels are expressed by analog control of the light emission, a PDP controls the grey level by modulating the number of light pulses per frame. This time-modulation will be integrated by the eye over a period corresponding to the eye time response.

When an observation point (eye focus area) on the PDP screen moves, the eye will follow this movement. Consequently, it will no more integrate the light from the same cell over a frame period (static integration) but it will integrate information coming from different cells located on the movement trajectory and it will mix all these light pulses together which leads to a faulty signal information.

Today, a basic idea to reduce this false contour effect is to detect the movements in the picture (displacement of the eye focus area) and to apply different type of corrections over this displacement in order to be sure the eye will only perceive the correct information through its movement. These solutions are described e.g. in EP-A-0 980 059 and EP-A-0 978 816 that are published European Patent Applications of the applicant.

Nevertheless, in the past, the motion estimator evolution was mainly focused on other applications than Plasma technology and the aim of a false contour compensation needs some adaptation to plasma specific requirements.

In fact, standard motion estimators work on video level basis and consequently they are able to catch a movement on a structure appearing at this video level (e.g. strong spatial gradient). If an error has been made on a homogeneous area, this will have no impact on standard video application like proscan conversion since the eye will not see any differences in the displayed video level (analog signal on CRT screen). On the other hand, in the case of a plasma screen, a small difference in the video level can come from a big difference in the light pulse emission scheme and this can cause strong false contour artefacts.

Invention

It is therefore an object of the present invention to disclose an adapted standard motion estimator for matrix displays like plasma display appliances. That is the key issue of this invention, which could be used for each kind of Plasma technology at each level of its development (even if the scanning mode and sub-field distribution is not well defined).

According to claim 1 the invention concerns a method for processing video pictures for display on a display device having a plurality of luminous elements corresponding to the pixels of a picture, wherein the time duration of a video frame or video field is divided into a plurality of sub-fields (SF) during which the luminous elements can be activated for light emission in small pulses corresponding to a sub-field code word which is used for brightness control, wherein to each sub-field a specific sub-field weight is assigned, wherein motion vectors are calculated for pixels and these motion vectors are used to determine corrected sub-field code words for pixels, characterized in that, a motion vector calculation is being made separately for one or more colour component (R,G,B) of a pixel and wherein for the motion estimation the sub-field code words are used as data input, and wherein the motion vector calculation is done separately for single sub-fields or for a sub-group of sub-fields from the plurality of sub-fields, or wherein the motion vector calculation is done based on the complete sub-field code words and the sub-field code words being interpreted as standard binary numbers.

Further advantageous measures are apparent from the dependent claims.

The invention consists also in advantageous apparatuses for carrying out the inventive method.

In one embodiment the apparatus for performing the method of claim 1, has a sub-field coding unit for each colour component video data, and corresponding compensation blocks (dFCC) for calculating corrected sub-field code words based on motion estimation data, and is characterized in that, the apparatus further has corresponding motion estimators (ME) for each colour component and that the motion estimators receive as input data the sub-field code words for the respective colour components.

In another embodiment the apparatus for performing the method of claim 1, has a sub-field coding unit for each colour component video data, and is characterized in that, the apparatus further has motion estimators for each colour component and the motion estimators are sub-divided in a plurality of single bit motion estimators (ME) which receive as input data a single bit from the sub-field code words for performing motion estimation separately for single sub-fields and that the apparatus has a corresponding plurality of compensation blocks (dFCC) for calculating corrected sub-field code word entries.

In a third embodiment the apparatus for performing the method of claim 1, has a sub-field coding unit for each colour component video data, and is characterized in that, the apparatus further has motion estimators for each colour component and the motion estimators are single bit motion estimators which receive as input data a single bit from the sub-field code words for performing motion estimation separately for single sub-fields and that the apparatus has corresponding compensation blocks (dFCC) for calculating corrected sub-field code word entries and wherein the motion estimators and compensation blocks are used repetitively during a frame period for the single sub-fields.

DRAWINGS

Exemplary embodiments of the invention are illustrated in the drawings and are explained in more detail in the following description.

In the figures:

FIG. 1 shows a video picture in which the false contour effect is simulated;

FIG. 2 shows an illustration for explaining the sub-field organization of a PDP;

FIG. 3 shows an example of a sub-field organisation with 10 sub-fields;

EXEMPLARY EMBODIMENTS

As previously said, a Plasma Display Panel (PDP) utilizes a matrix array of discharge cells that can only be "ON" or "OFF". In a PDP the pixel colours are produced by modulating the number of light pulses of each plasma cell per frame period. This time modulation will be integrated by the eye over a period corresponding to the human eye time response.

In TV technology an 8-bit representation of the video levels for the RGB colour components is very common. In that case is each level will be represented by a combination of the 8 following bits:

1-2-4-8-16-32-64-128

To realize such a coding with the PDP technology, the frame period will be divided in 8 lighting periods (called sub-fields), each one corresponding to a bit. The number of light pulses for the bit "2" is the double as for the bit "1" and so on. With these 8 sub-periods, it is possible through combination, to build the 256 different video levels. Without motion, the eye of the observers will integrate over about a frame period these sub-periods and catch the impression of the right grey level. FIG. 2 represents this decomposition. In this figure the addressing and erasing periods of every sub-field are not shown. The plasma driving principle however requires also these periods. It is well known to the skilled man, that during each sub-field a plasma cell needs to be addressed, first in an addressing or scanning period, afterwards the sustain period follows where the light pulses are generated and finally in an erase period the charge in the plasma cells is quenched.

This PWM-type light generation introduces new categories of image-quality degradation corresponding to disturbances of grey levels or colours. The name for this effect is dynamic false contour effect since the fact that it corresponds to the apparition of coloured edges in the picture when an observation point on the PDP screen moves. Such failures on a picture lead to an impression of strong contours appearing on homogeneous area like skin. The degradation is enhanced when the image has a smooth gradation and also when the light-emission period exceeds several milliseconds. In addition, the same problems occur on static images when observers are moving their heads and that leads to the conclusion that such a failure depends on the human visual perception.

Figures 4, 5:
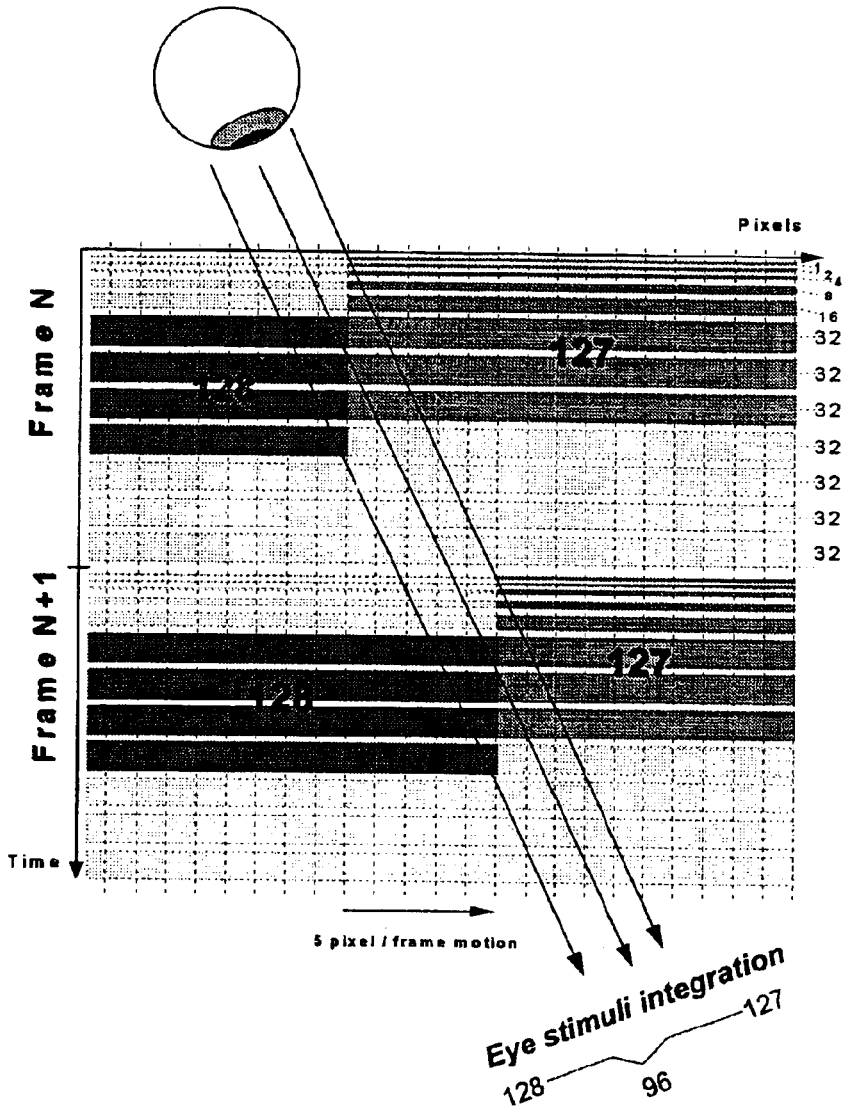
FIG. 4 shows an example of a sub-field organisation with 12 sub-fields.
FIG. 5 shows an illustration for explaining the false contour effect.

In order to improve the picture quality of moving images, sub-field organisations with more than 8 sub-fields are used today. FIG. 3 shows an example of such a coding scheme with 10 sub-fields and FIG. 4 shows an example of a sub-field organisation with 12 sub-fields. Which sub-field organisation is best to be taken, depends on the plasma technology. Some experiments are advantageous with this respect.

For each of these examples, the sum of the weights is still 255 but the light distribution of the frame duration has been changed in comparison to the previous 8-bit structure. This light emission pattern introduces new categories of image-quality degradation corresponding to disturbances of grey levels and colours. These will be defined as dynamic false contour since the fact that it corresponds to the apparition of coloured edges in the picture when an observation point on the PDP screen moves. Such failures on a picture lead to an impression of strong contours appearing on homogeneous areas like skin and to a degradation of the global sharpness of moving objects. The degradation is enhanced when the image has a smooth gradation and also when the light-emission period exceeds several milliseconds.

In addition, the same problems occur on static images when observers are shaking their heads and that leads to the conclusion that such a failure depends on the human visual perception.

As already said, this degradation has two different aspects:

- on homogeneous areas like skin, it leads to an apparition of coloured edges;
- on sharp edges like object borders, it leads to a blurred effect reducing the global picture sharpness impression.

To understand a basic mechanism of visual perception of moving images, two simple cases will be considered corresponding to each of the two basis problems (false contouring and blurred edges). These two situations will be presented in the case of the following 12 sub-field encoding scheme:

1-2-4-8-16-32-32-32-32-32-32-32

First case considered, is a transition between the level 128 and 127 moving at 5 pixel per frame, the eye following this movement. This case is shown in FIG. 5.

FIG. 5 represents in light grey the lighting sub-fields corresponding to the level 127 and in dark grey, these corresponding to the level 128.

The diagonal parallel lines originating from the eye indicate the behaviour of the eye integration during a movement. The two outer diagonal eye-integration-lines show the borders of the region with faulty perceived luminance. Between them, the eye will perceive a lack of luminance, which leads to the appearing of a dark edge as indicated in the eye stimuli integration curve at the bottom of FIG. 5.

Figure 6:
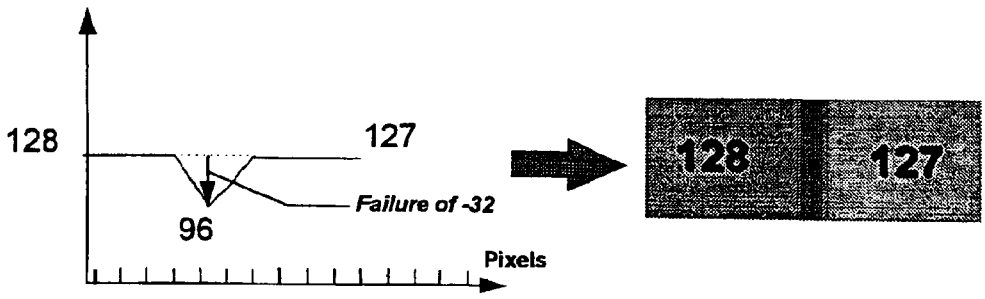
FIG. 6 illustrates the appearance of a dark edge when a display of two frames is being made in the manner shown in FIG. 5.

In case of a grey scale picture this effect corresponds to the apparition of artificial white or black edges. In the case of coloured pictures, since this effect will occur independently on the different colour components, it will lead to the apparition of coloured edges in homogeneous areas like a skin. This is also illustrated in FIG. 6 for the same moving transition.

Figure 7:
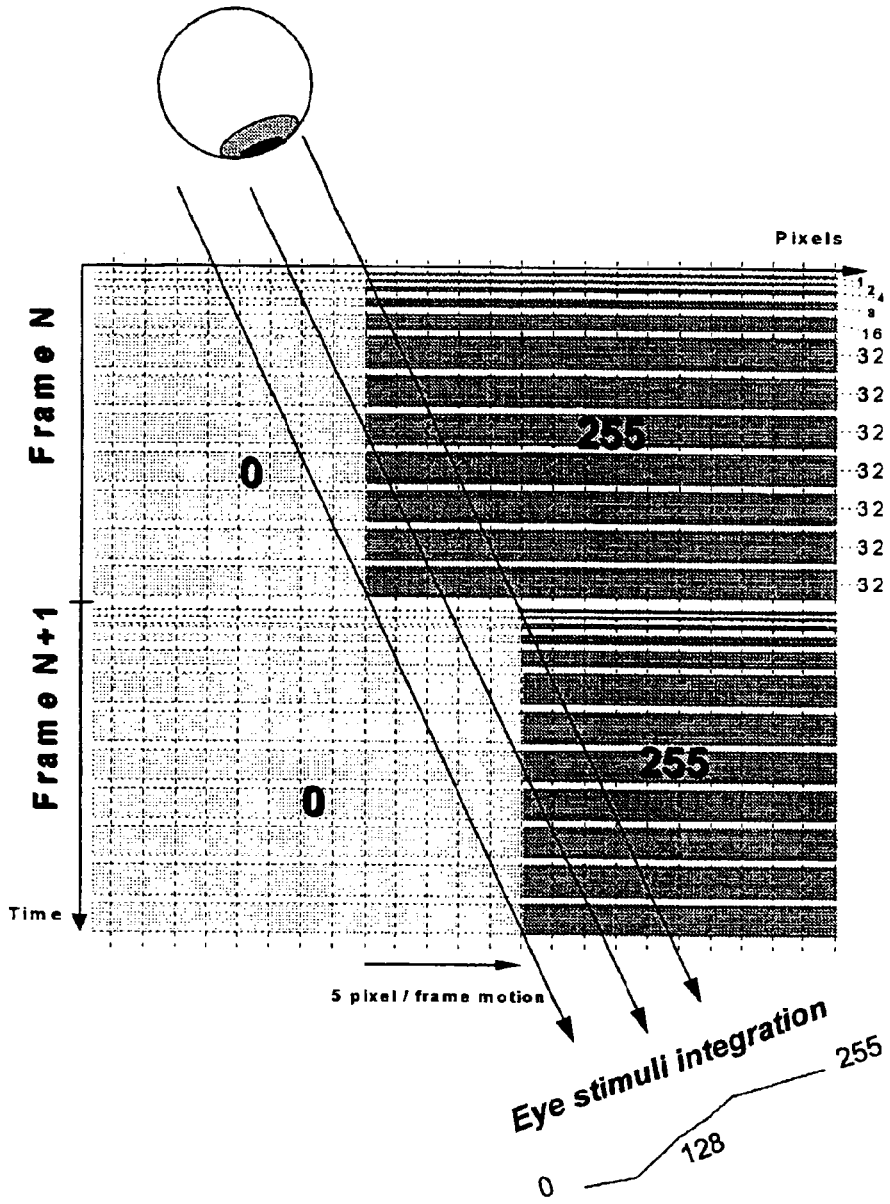
FIG. 7 shows an illustration for explaining the false contour effect appearing due to display of a moving black-white transition.

Second case considered is a pure black to white transition between the level 0 and 255 moving at 5 pixel per frame, the eye following this movement. This case is depicted in FIG. 7. The figure represents in grey the lighting sub-fields corresponding to the level 255.

Figure 8:
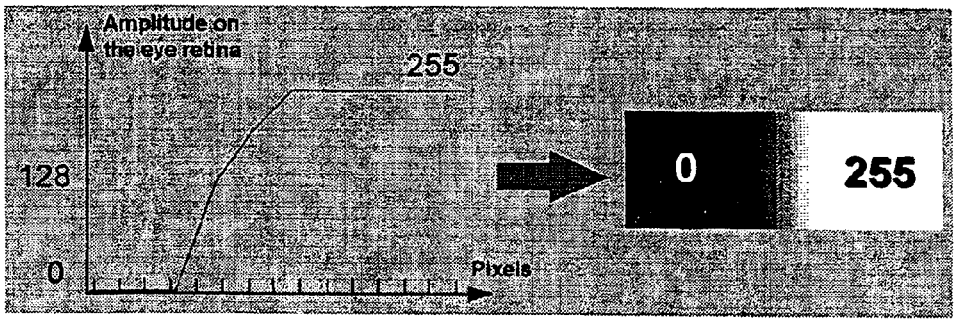
FIG. 8 illustrates the appearance of a blurred edge when a display of two frames is being made in the manner shown in FIG. 7.

The two extreme diagonal eye-integration-lines show again the borders of the region where a faulty signal will be perceived. Between them, the eye will perceive a growing luminance, which leads to the appearing of a shaded or blurred edge. This is shown in FIG. 8.

Consequently, the pure black to white transition will be lost during a movement and that leads to a reduction of the global picture sharpness impression.

As explained above, the false contour effect is produced on the eye retina when the eye follows a moving object since the eye does not integrate the right information at the right time. There are different methods to reduce such an effect but the more serious ones are based on a motion estimator (dynamic methods), which aim to detect the movement of each pixel in a frame in order to anticipate the eye movement or to reduce the failure appearing on the retina through different corrections.

In other words, the goal of each dynamic algorithm is to define for each pixel observed by the eye, the way the eye is following its movement during a frame in order to generate a correction on this trajectory. Such algorithms are described e.g. in EP-A-0 980 059 and EP-A-0 978 816 which are European patent applications of the applicant.

Consequently, for each pixel of the frame N, we will dispose of a motion vector $\vec{V}=(V_x;V_y)$, which describes the complete motion of the pixel from the frame N to the frame N+1, and the goal of a false contour compensation is to apply a compensation on the complete trajectory defined by this vector.

In the following, it is not focused on the compensation itself but merely on the motion estimation. For the compensation of the false contour effect it is referred to a method using sub-field shifting operation in the direction of the motion vector for the pixels in a critical area. The corresponding sub-field shifting algorithm is described in detail in EP-A-0 980 059. For the disclosure regarding this algorithm it is therefore expressively referred to this document. Of course, there exist some other algorithms for false contour effect reduction, but the sub-field shifting algorithm gives very promising results.

Such a compensation applied to moving edges will improve its sharpness on the eye retina and the same compensation applied to moving homogeneous areas will reduce the appearance of coloured edges.

It is however, expressively mentioned that such a compensation principle needs motion information from a motion estimator for both kind of areas: homogeneous ones and object borders. In fact, today, the standard motion estimators are working on luminance signal video level. It is well known to the skilled man that the luminance signal Y is a combination of the signals for the three colour components. The following equation is taken to generate the luminance signal:

$$U_Y=0.3U_R+0.5U_G+0.11U_B$$

Based on the luminance signal it is possible to reliably detect the motion of edges but it is much more difficult to detect the motion of an homogeneous area.

In order to understand more clearly this problem, a simple example will be presented, the case of a ball moving on a white screen from the frame N to the frame N+1. Standard motion estimators try to find a correlation between a sub-part of the first picture (frame N) and a sub-part of the second picture (frame N+1). The size, form and type of these subparts depend on the motion estimator type used (block matching, pel recursive, etc.). Widely used are block matching motion estimators. A simple block matching process will be studied in order to show the problematic. In that case, each frame will be subdivided in blocks and a matching will be searched between blocks from two consecutive frames in order to compute the movement of the ball.

Figure 9:
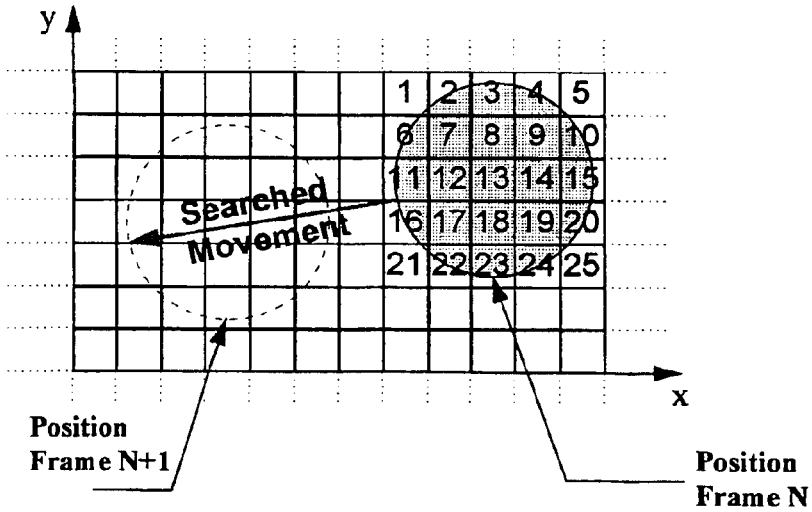
FIG. 9 illustrates the block matching process in motion estimators working on video level or luminance basis.

As shown in FIG. 9 the ball in frame N will be subdivided in 25 blocks. The position of the ball in the next frame N+1 is indicated with the dashed circle.

Figure 10:
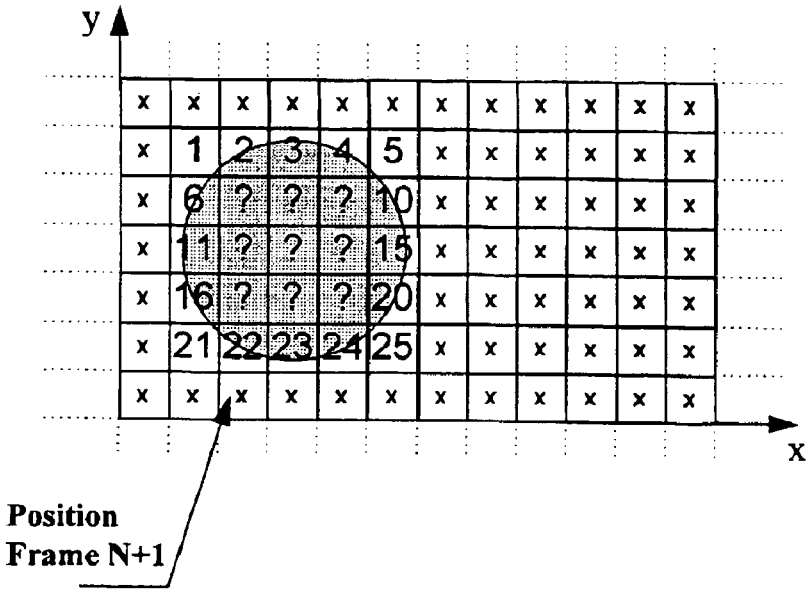
FIG. 10 illustrates the result of the block matching operation shown in FIG. 9.
Figure 11:
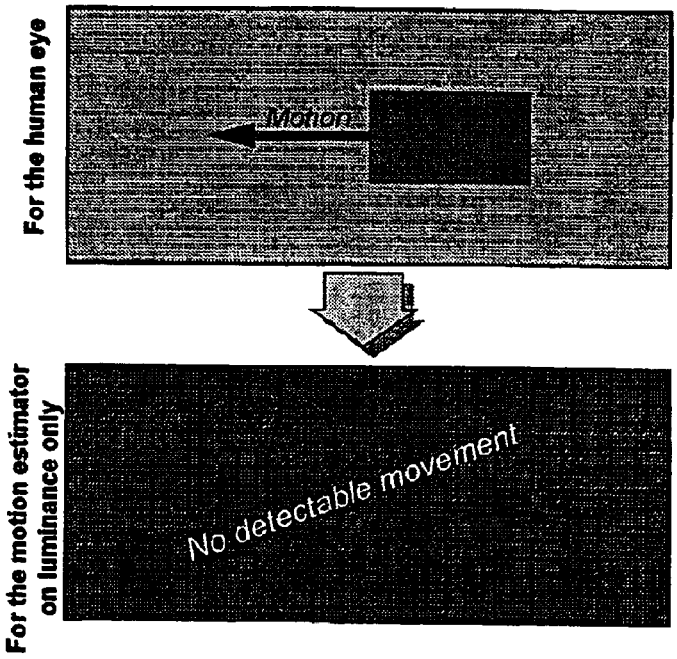
FIG. 11 illustrates that motion estimators relying on luminance values cannot estimate motion in specific cases.

The best matches with the 25 pixel blocks in frame N+1 are shown in FIG. 10. The blocks having a unique match are indicated with the same number as in the frame N, the blocks having no match are represented with an "x" and the block with more than one match (no defined motion vector) are represented with a "?".

In the undefined area represented with "?" these motion estimators working on luminance signal level have no chance to find a precise motion vector, since the video level is about the same in all these blocks (e.g. video levels from 120 to 130). Some estimators will produce from such areas very noisy motion vectors or will declare these areas as non-moving areas.

Nevertheless, it was explained that a transition 127/128 definitely produces a severe false contour effect and consequently it is important to compensate also such areas and for that purpose a precise motion field is needed at this location.

For that reason, there is a lack of information coming from standard motion estimators and therefore such kind of motion estimators need an adaptation to the new plasma requirements.

According to the invention there is proposed an adaptation of the motion estimators, which is based on two ideas.

The first idea can be summarized: "Detection based on separate colour components."

In the previous paragraphs, the false contour explanations have shown that the false contour effect appears separately on the three colour components. Consequently it seems important to compensate separately the different colour components and to do that, independent motion vectors for the three colour components are required.

In order to support this affirmation, the example of a magenta-like square moving on a cyan-like background is presented.

The magenta-like colour is made for instance with the level 100 in BLUE and RED and without GREEN component. The cyan-like colour is made for instance with the level 100 in BLUE and 50 in GREEN and without RED component.

The luminance signal level 40 is for both colours identical. There is no difference at all on luminance signal basis between the moving square and the background. The whole picture has got the same luminance level. Consequently, each motion estimator working on luminance values only will not be able to detect a movement.

The eye itself will detect a movement and will follow this movement and that leads to a false contour effect appearing at the square transitions for the green and red components only.

In fact, the blue component is homogeneous in the whole picture and for that reason, no false contour is produced in this component.

For this example it is therefore necessary to estimate the motion in the picture based on the components RED and GREEN and not for the blue one. It is evident, that in the general case it is an improvement for motion estimation to make the motion estimation for the three colour components separately.

The second aspect of the invention for an adaptation of the motion estimation can be summarized: "Detection based on sub-field level".

In the previous paragraphs, the false contour explanations have shown that a transition 127/128 will produce a false contour effect, which could be very disturbing for the eye. Since this false contour effect occurs in transitions which are almost invisible at the luminance signal level, it is likely that the motion vectors determined for this area are false and as a consequence the compensation itself will not work properly.

Nevertheless, if the sub-field code words of a colour component are used for motion estimation, this makes a big difference. Using the example of the sub-field encoding based on 12 sub-fields (1-2-4-8-16-32-32-32-32-32-32-32) the video levels 127 and 128 can be represented as following:

| Standard 8 bit video Level | 12 bit coded value (MSB⇨LSB) | Corresponding 12 bit video level |
|---|---|---|
| 127 (01111111) | 000011111111 | 255 |
| 128 (10000000) | 000111100000 | 480 |

Consequently, a motion estimator working on each colour component after the sub-field encoding will dispose of more bit information and will be able to compensate more precisely the false contour effect appearing in the homogeneous areas.

As already said in the previous parts of this document, all motion estimators focus their estimation on the movement of structures or gradients which are easy to estimate and then try to extend this estimation to neighbourhood areas.

It is therefore a further aspect of the invention to redefine the notion of gradient since the false contour failure appears at sub-field level and not at video level.

Again the example of the gradient on video level for the transition 127/128. This gradient has an amplitude of 1 (128−127) but if we take a look on the bit changing, we can see that even with an 8 bit coding all bits are different between these two values. In case of 12-bit sub-field encoding, there is a difference in 6 bits between the two values. Consequently, it is an improvement if the gradient refers to the bit changing between two values and not to the level changing between them. In addition, it is evident that the failure appearing on the retina in case of moving pictures depends on the weight of the sub-fields that will be faulty integrated. For that reason, it is proposed to define a new type of gradients called "binary gradients", through the bit changing at sub-field level, each bit being weighted by its sub-field weight. These new binary gradients need to be detected in the picture. This definition of binary gradients aims to focus the motion estimation on the sub-field changing areas and not on the video level changing areas.

Figure 12:
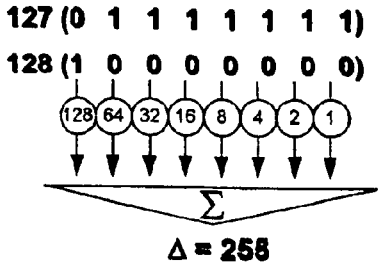
FIG. 12 illustrates the calculation of binary gradients in case of a 127/128 transition and standard 8 bit coding.
Figure 13:
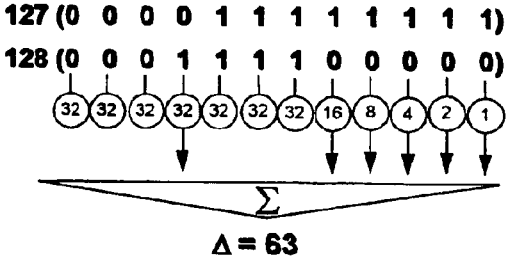
FIG. 13 illustrates the calculation of binary gradients in case of a 127/128 transition and 12 sub-field coding.

The building of binary gradients according to the new definition is illustrated in FIGS. 12 and 13 for the transition 127/128 with different sub-field coding schemes. In FIG. 12 the standard B-bit coding scheme is used and in FIG. 13 the specific 12-bit encoding scheme is used.

With 8 bit encoding scheme, the binary-gradient has the value 255 which, in that case, corresponds to the maximum amplitude of the false contour failure, which could appear at such a transition.

With this 12 bit sub-field encoding, the binary-gradient has a value of 63. It is evident from this that the 12 bit sub-field organisation is less susceptible to the false contour effect.

Figure 14:
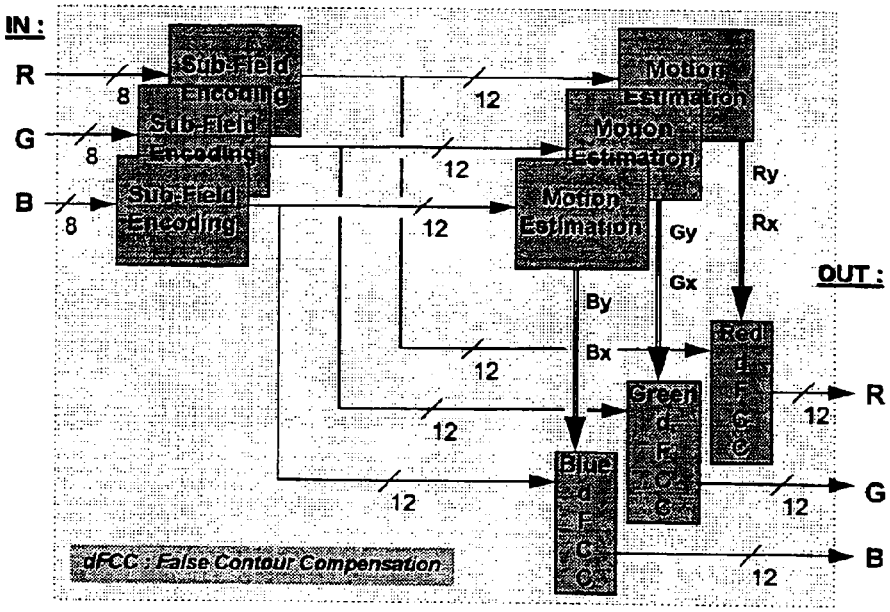
FIG. 14 depicts a block diagram for an apparatus for false contour effect reduction with motion estimation on each colour component.

These two previous examples show the way a plasma adapted motion estimator can be improved in order to focus on the detection of critical moving transitions for the false contour problem. FIG. 14 shows a block diagram for an adapted false contour compensation apparatus.

The inputs in this embodiment are the three colour components at video level and the outputs are the compensated sub-field-code words for each colour component, which will be sent to the addressing control part of the PDP. The information Rx and Ry corresponds to the horizontal and vertical motion information for the Red component, Gx and Gy for the green, Bx and By for the blue component.

Figure 15:
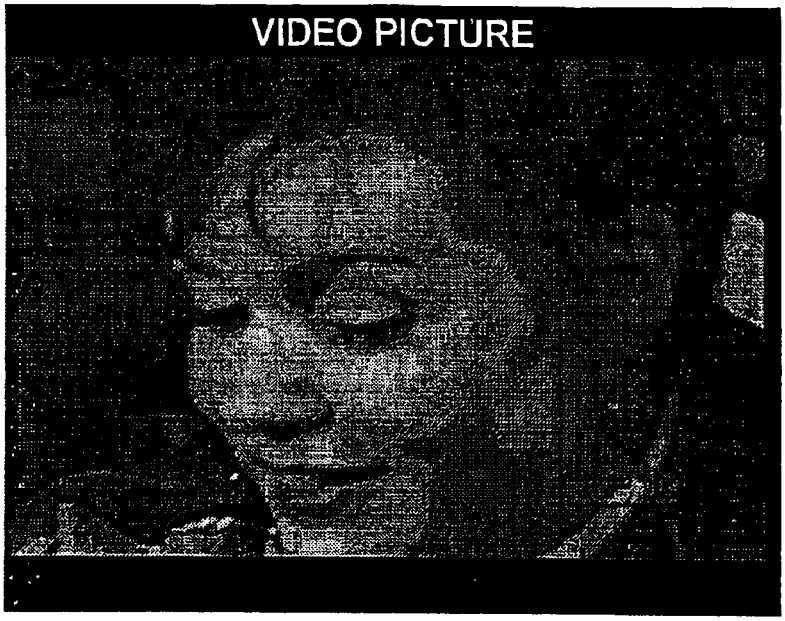
FIG. 15 shows a video picture according to 8 bit values of the colour components.

In order to understand more precisely the reasons of this motion detection based on sub-fields information, an example of a natural TV sequence has been chosen. This sequence is naturally blurred and that leads to large homogeneous areas and to a lack of information at video level for a standard motion estimation on these areas as seen on the picture of FIG. 15.

On the other hand, the same picture represented on sub-fields level (with 12 bit), where each sub-field code word is interpreted as a binary number, will provide more information in these critical areas. The corresponding sub-field picture is shown in FIG. 16.

Figure 16:
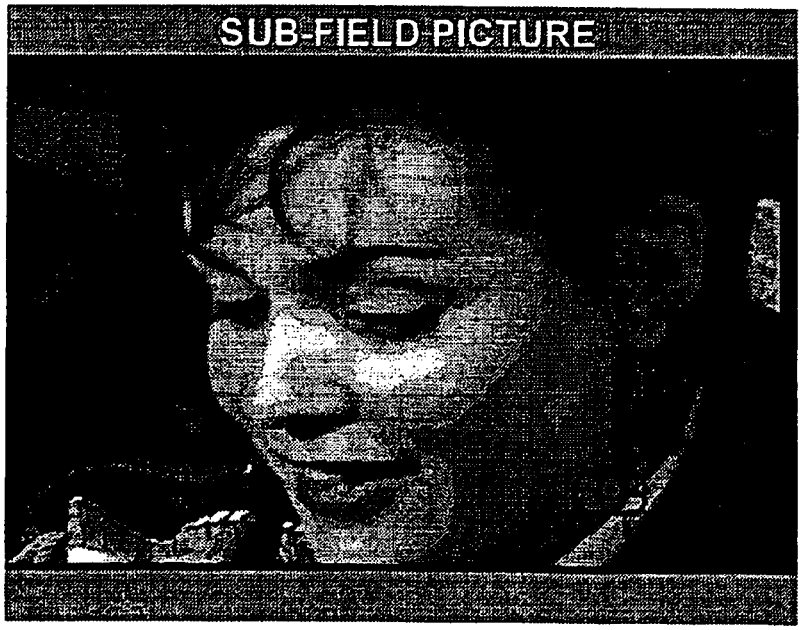
FIG. 16 shows the same video picture as in FIG. 15 but with different video levels derived from the sub-field code words.

In the picture of FIG. 16 a lot of new regions appear in the face of the woman. These correspond to a different sub-field structure and consequently their borders (sub-field transitions) are the location of false contour effect appearance like in the example 127/128 transition mentioned above. For that reason, an improvement can be achieved, if a plasma dedicated motion estimator has to provide a precise motion vector of such sub-field transitions.

In fact, the most motion estimators today are working on the detection of moving gradients (e.g. pel recursive) and moving structures (e.g. block matching) and a comparison of the extracted edges from the two previous pictures shows the improvement introduced through an analysis on sub-fields level. This is shown in FIG. 17.

Figure 17:
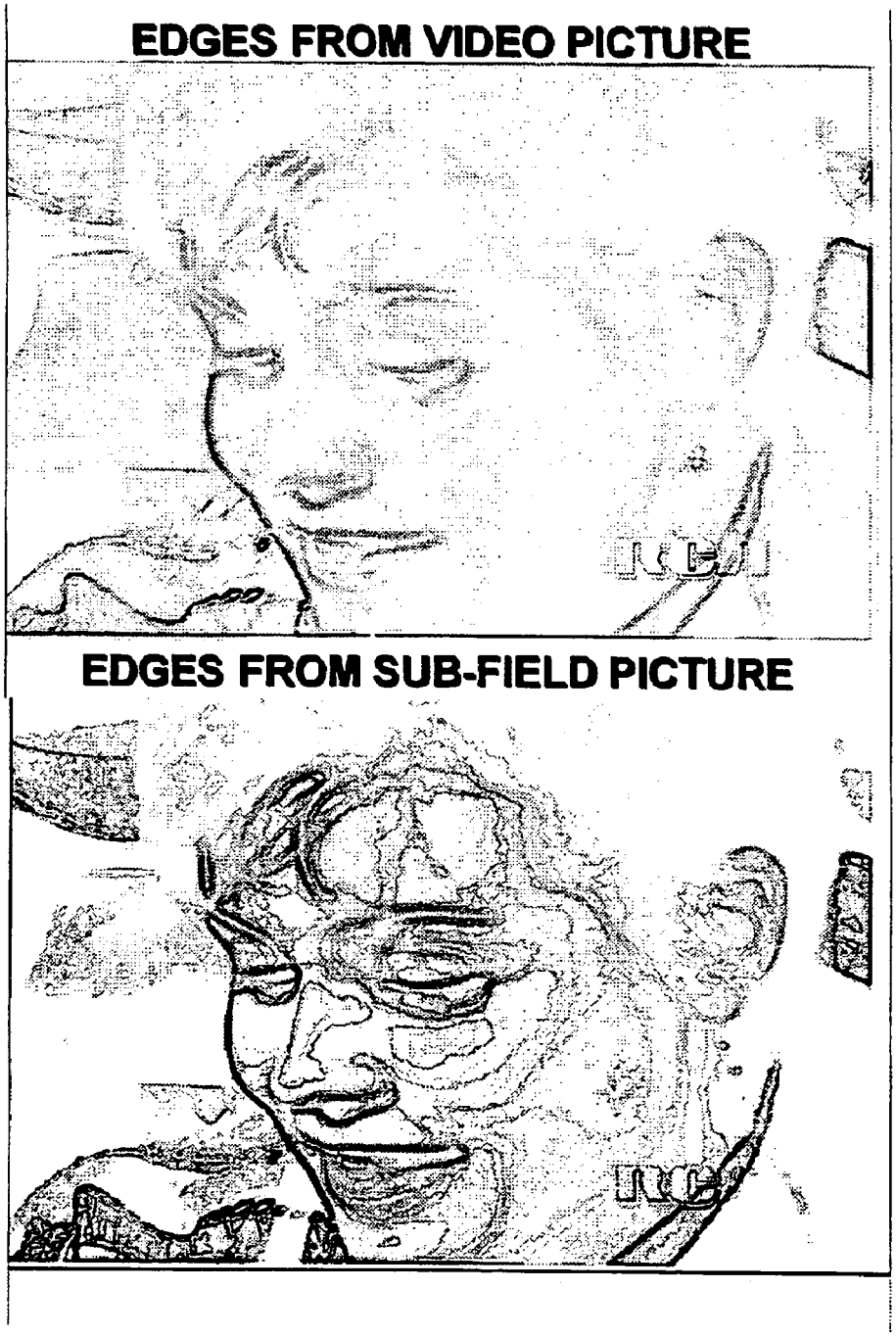
FIG. 17 shows extracted edges from the video picture shown in FIG. 15 where the colour components are represented first with 8 bit values and second with 12 bit sub-field code words.

The lower picture in FIG. 17 represents standard edges extracted from a 12-bit picture. It is obvious that there is much more information in the face for a motion estimator. All these edges are real critical ones for the false contour effect and should be properly compensated.

As a conclusion, it is evident that there are two possibilities to increase the quality of a motion estimator at sub-fields level. The first one is to use a standard motion estimator but replacing its video input data with sub-field code word data (more than 8 bit). This will increase the amount of available information but the gradients used by the estimators will stay standard ones. A second possibility to further increase its quality is to change the way of comparing pixels e.g. during block matching. If the so-called binary-gradients, as defined in this document are computed, then the critical transitions are easily found.

There is another possibility to further improve the quality of the motion estimation according to this invention. It consists in a separately motion estimation of each sub-field. In fact, since the false contour effect appears on the sub-field level, it is proposed to compensate the movement of sub-fields. For that purpose an estimation of the movement in the picture for each sub-field separately could be a serious advantage.

Figure 18:
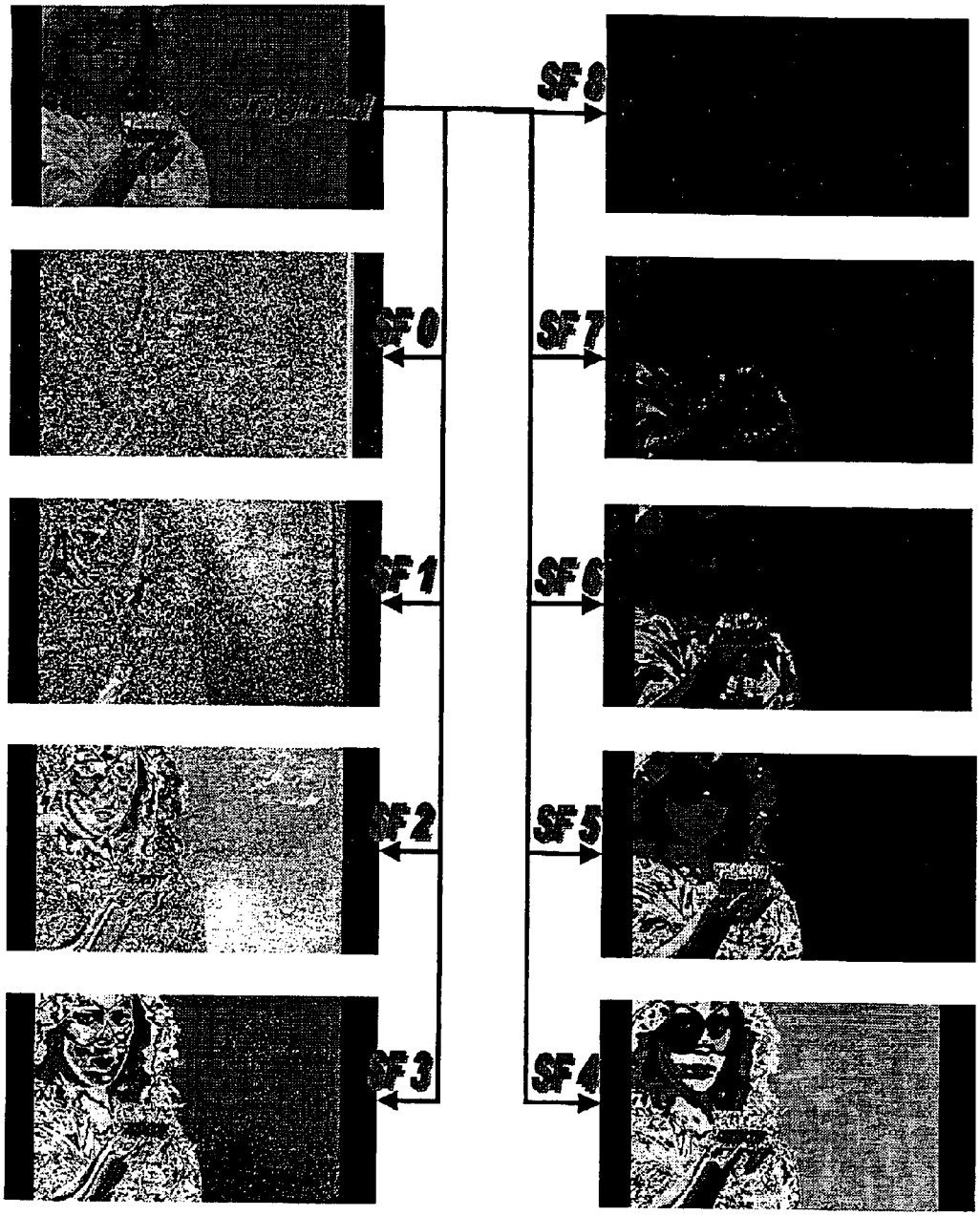
FIG. 18 shows a decomposition of a picture in pictures corresponding to single sub-field data.
Figure 19:
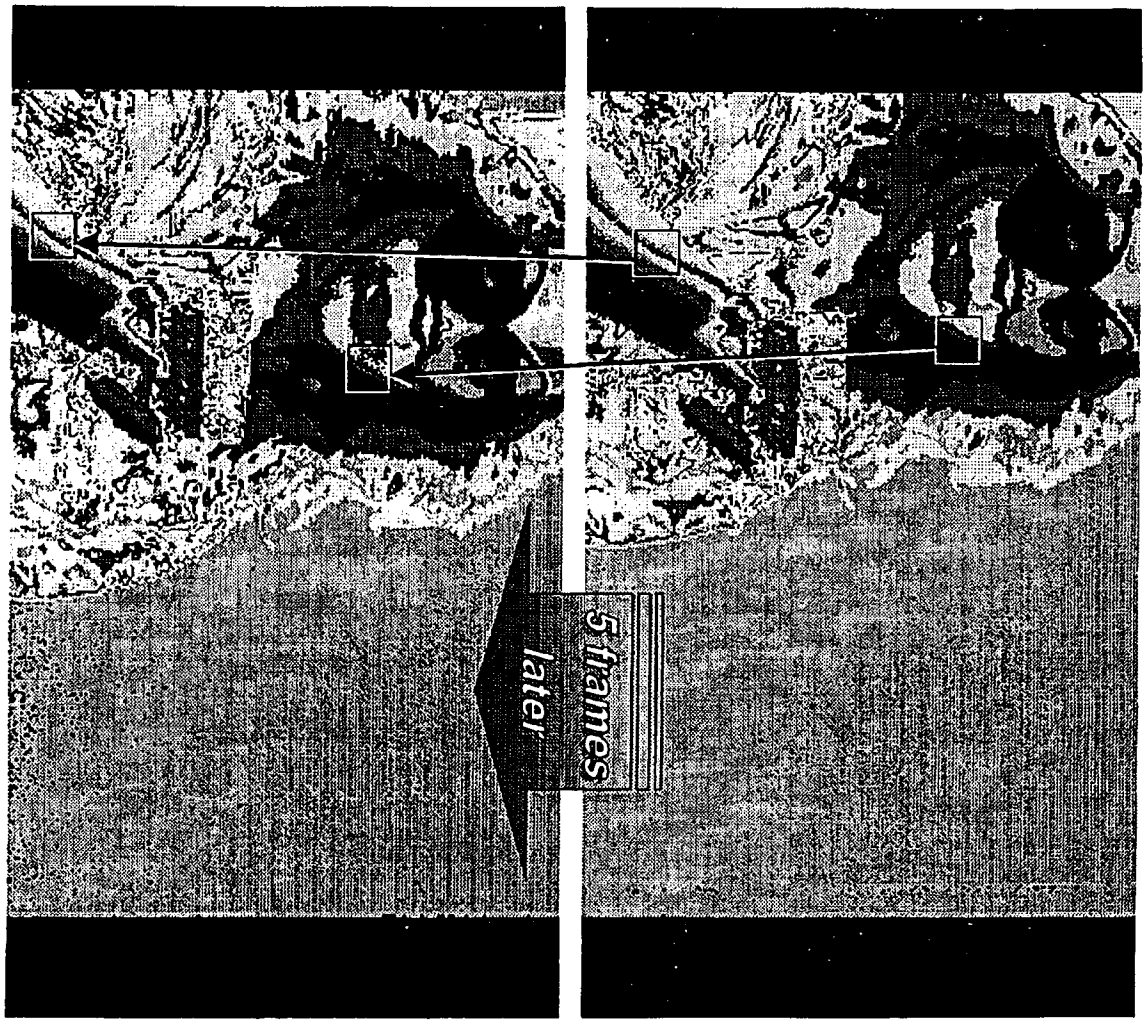
FIG. 19 shows motion estimation in the picture with sub-field data SF4 from FIG. 18.

In this case a picture based on a certain sub-field code word entry is a binary picture containing only binary data 0 or 1 as pixel values. Since the fact that only the higher sub-field weights will cause serious picture damages, the motion detection can concentrate on the most significant sub-fields, only. This is illustrated in FIG. 18. This figure represents the decomposition of one original picture in 9 sub-field pictures. The sub-field organisation is one with 9 sub-fields SF0 to SF8. In the picture for sub-field 0, there is not much structure of the original picture seen. The sub-field data represent some very fine details that do not allow to see the contours in the picture. It is remarked, that the picture is presented with all three colour components. Also in the pictures for sub-fields SF1 to SF3 the picture structure is not seen clear enough. However, the transitions on the arm (which are false contour critical) appear already in the sub-field picture for sub-field SF2 and after. Especially this structure is very good viewable in the picture for sub-field SF4. Therefore, motion estimation made based on SF4 data, will deliver very good results for false contour compensation. This is further illustrated in FIG. 19. The picture for sub-field SF4 is shown in the upper part. In the lower part, the corresponding picture 5 frames later is shown. From these pictures it is obvious that it is possible to estimate the movement of two blocks located on some given structure in the picture reliably. In that case, with a simple motion estimator (e.g. block matching, pel recursive) it is possible to determine the movement of the sub-fields between two consecutive frames and to modify its position depending on its real time position in the frame.

In that case, simple motion estimators are used in parallel since they are working on 1 bit-pictures, only. This will be done to extract from each single sub-field picture a motion vector field, which will be used for the compensation in the corresponding sub-field. Practically speaking, for each pixel and each sub-field a motion vector is calculated. The motion vector then is used to determine a sub-field entry shift for compensation. The sub-field shifting calculation can be done as explained in EP-A-0 980 059. The center of gravity of the sub-field needs to be taken into account as disclosed there.

Figure 20:
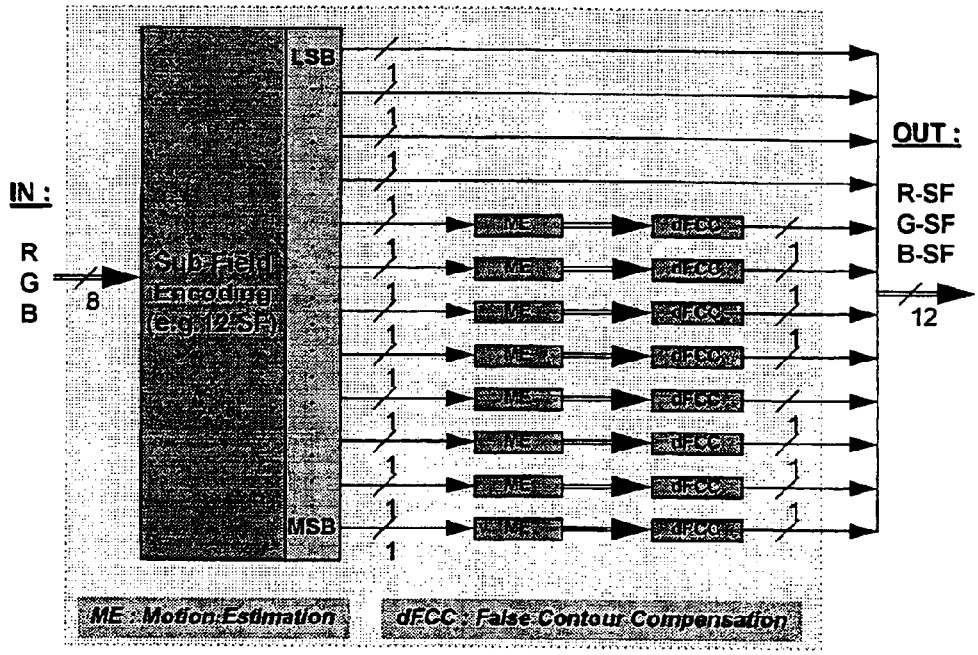
FIG. 20 shows a block diagram for an apparatus for false contour effect reduction with separate motion estimation for single sub-fields.

FIG. 20 shows a block diagram for this embodiment.

In this block diagram, a compensation based on the 8 most significant sub-fields in the case of a 12 sub-fields encoding has been represented. Only these 8 MSBs will be estimated with a simple motion estimator based on 1-bit pictures, and then compensated.

One big advantage of such a principle is the strong reduction of complexity for the motion estimators (less on-chip memory, simpler memory management, very simple computations). In fact the die-size will be reduced since each line memory needed by the motion estimator will correspond to a pixel depth of 1 bit only (low resources on-chip).

Figure 21:
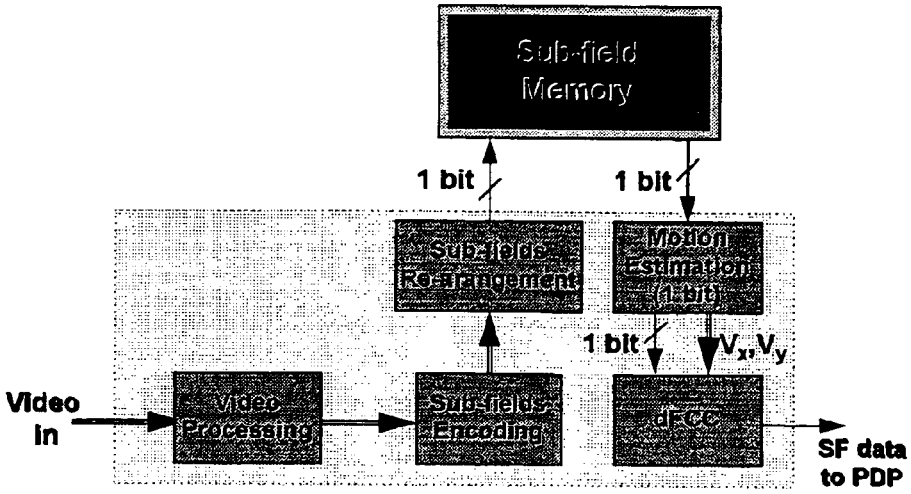
FIG. 21 shows a further block diagram for an apparatus for false contour effect reduction.

In addition, in case of the ADS addressing scheme (Address Display Separately), the memory management will be simplified since the structure of ADS needs to store separately the different sub-fields in a sub-field memory. These sub-fields, will be read each after the other to be displayed on the screen. Obviously, the compensation can be made at this processing stage, i.e. after having the 1 bit sub-field pictures memorised. This allows to use only one motion estimator with 1 bit depth for all 1 bit sub-field pictures. This solution is disclosed in the block diagram of FIG. 21. In this block diagram, video data is input to a video processing unit in which all video processing steps based on 8 bit video data is performed such as interlace proscan conversion, colour transition improvement, edge replacement, etc. The video data of each colour component is then sub-field encoded in the sub-fields encoding block according to a given sub-field organisation e.g. the one shown in FIG. 3 with 10 sub-fields. The sub-field code word data are then re-arranged in the sub-fields re-arrangement block. This means that in corresponding sub-field memories, all the data bits of the pixels for one dedicated sub-field are stored. There need to be as much sub-field memories as sub-fields are present in the sub-field organisation. In the case of 10 sub-fields in the sub-field organisation, this means 10 sub-field memories are required for storing the sub-field code words for one picture.

The motion estimation is performed in this arrangement for the selected sub-fields separately. As motion estimators need to compare at least two successive pictures, there is the need of some more sub-field memories for storing the data of the previous or next picture.

The sub-field code word bits are forwarded to the dynamic false contour compensation block dFCC together with the motion vector data. The compensation is carried out in this block e.g. by sub-field entry shifting as explained above.

In this architecture, there is only the need of one 1-bit motion estimator, which can be used for all sub-fields. It is however remarked, that there are sub-field code words for each colour components and that therefore there is the need to have the components sub-field encoding, sub-field rearrangement, sub-field memory, motion estimation and dFCC in triplicate.

There are a number of modifications possible to the disclosed invention. E.g. one variation is to make the motion estimation on a selected group of sub-fields in the sub-field organisation instead of single sub-fields, separately. E.g. it could be possible to make the motion estimation based on two bit code words for the sub-fields 3 and 4 in one embodiment. The compensation for those sub-fields is then being done with the motion vector for the group of sub-fields. This is also an embodiment according to this invention.

Another modification is to calculate an average motion vector from all the motion vectors for the single or grouped sub-fields before applying the compensation. Also this is a further embodiment according to this invention.

What is claimed is:

1. Method for processing video pictures for display on a display device having a plurality of luminous elements corresponding to the pixels of a picture, wherein the time duration of a video frame or video field is divided into a plurality of sub-fields during the luminous elements can be activated for light emission in small pulses corresponding to a sub-field code word which is used for brightness control, wherein to each sub-field a specific sub-field weight is assigned, wherein the video signals for the pixels of a picture are sampled, said video signal samples are represented by video data words having N bits, wherein to the video data words sub-field code words are assigned having N+X bits, N and X being integer numbers, wherein with motion estimation motion vectors are calculated for pixels in a video picture, and these motion vectors are used to determine corrected sub-field code words for pixels, wherein, a motion vector calculation is being made separately for one or more colour components of a pixel, wherein for the motion vector calculation the sub-field code words having N+X bits are used as data input instead of the video data words having N bits for a colour component, and wherein the motion vector calculation is done based on the complete sub-field code words or based on code words that are formed from the entries in the sub-field code words of only a sub-group of sub-fields from the plurality of sub-fields and the motion vector defines a trajectory along which corrected sub-field code words will be placed.

2. Method according to claim 1, wherein for the case that a motion vector calculation is done based on the complete sub-field code words or for a sub-group of sub-fields, a gradient determination step is performed for comparing pixels in two successive frames, with the gradient between two pixels being defined as the sum of the sub-field weights of those sub-fields of the sub-field code words or sub-group of the sub-field code words which have different binary entries.

3. Method for processing video pictures for display on a display device having a plurality of luminous elements corresponding to the pixels of a picture, wherein the time duration of a video frame or video field is divided into a plurality of sub-fields during which the luminous elements can be activated for light emission in small pulses corresponding to a sub-field code word which is used for brightness control, wherein to each sub-field a specific sub-field weight is assigned, wherein motion vectors are calculated for pixels in a video picture, and these motion vectors are used to determine corrected sub-field code words for pixels, wherein, a motion vector calculation is being made separately for one or more colour component of a pixel, and for the motion vector calculation the sub-field code words are used as data input instead of the video signal samples for a colour component, and wherein a motion vector calculation is done based on a single bit picture, wherein each pixel of the single bit picture is equal to a dedicated entry of the corresponding sub-field code word for that pixel, namely the entry for a dedicated single sub-field from the plurality of sub-fields.

4. Method according to claim 3, wherein the resulting motion vector calculated based on a single bit picture is used to calculate corrected sub-field code word entries for only the sub-field based on which the motion vector calculation has been made.

5. Method according to claim 3, wherein motion vectors are calculated separately for those sub-fields having the higher sub-field weights.

6. Method according to claim 3, wherein the resulting motion vectors calculated from single bit pictures for a pixel are averaged and the averaged motion vector is used to calculate corrected sub-field code word entries for the sub-field code words.

7. Method according to claim 1, wherein for the determination of corrected sub-field code words sub-field entry shifts are calculated for a given pixel based on the calculated motion vector and wherein the sub-field entry shifts determine which sub-field entry in the sub-field code word of a given pixel need to be shifted to which pixel position along the direction of the motion vector.

8. Method according to claim 1, wherein it is used in a plasma display device for dynamic false contour compensation.

9. Apparatus for performing the method of claim 3, having a sub-field coding unit for each colour component video data, wherein, the apparatus further has motion estimators for each colour component and the motion estimators are sub-divided in a plurality of single bit motion estimators which receive as input data the single bit pixels from the sub-field code words for performing motion estimation separately for a single sub-field and that the apparatus has a corresponding plurality of compensation blocks for calculating corrected sub-field code word entries.

10. Apparatus for performing the method of claim 1, having a sub-field coding unit for each colour component video data, and corresponding compensation blocks for calculating corrected sub-field code words based on motion vector data, characterized in that, the apparatus further has corresponding motion estimators for each colour component and that the motion estimators receive as input data the sub-field code words having N+X bits instead of the video data words having N bits for the respective colour components.

11. Method for processing video pictures for display on a display device having a plurality of luminous elements corresponding to the pixels of a picture, wherein the time duration of a video frame or video field is divided into a plurality of sub-fields during which the luminous elements can be activated for light emission in small pluses corresponding to a sub-field code word which is used for brightness control, wherein to each sub-field a specific sub-field wieght is assisgned, wherein the pixels are represented by video data words having N bits, wherein to the video data words sub-field code words are assigned having N + X bits, N and X being integer numbers, wherein with motion estimation motion vectors are calculated for pixels in a video picture, and these motion vectors, are used to determine corrected sub-field code words for pixels, wherein, a motion vector calculation is being made separately for one or more clour components of a pixel, wherein for the motion vector calculation the complete sub-field code words having N + X bits or code words that are formed from the entries in the sub-fields code words of only a sub-group of sub-fields from the plurality of sub-fields are used as data input instead of the video data words having N bits for a colour component, and wherein the motion vector calculation is done based on the complete sub-field code words or based on said code words that are formed from the entries in the sub-field code words of only a sub-group of sub-fields from the plurality of sub-fields and the motion vector defines a trajectory along which corrected sub-field code words will be placed.

12. Method according to claim 11, wherein for the case that a motion vector calculation is done based on the complete sub-field code words or for a sub- group of sub-fields, a gradient determination step is performed for comparing pixels in two successive frames, with the gradient between two pixels being defined as the sum of the sub-field weights of those sub-fields of the sub-field code words or sub-group of the sub-field code words which have differenct binary entries.

13. Method according to claim 11, wherein for the determination of corrected sub-field code words sub-field entry shifts are calculated for a given pixel based on the calculated motion vector and wherein the sub-field entry shifts determine which sub-field entry in the sub-field code word of a given pixel need to be shifted to which pixel position along the direction of the motion vector.

14. Method according to claim 11, wherein it is used in a plasma display device for dynamic false contour compensation.

15. Apparatus for performing the method of claim 11, having a sub-field coding unit for each colour component video data, and corresponding compensation blocks for calculating corrected sub-field code words based on motion vector data, characterized in that, the apparatus further has corresponding motion estimators for each colur component and that the motion estimators receive as input data the complete sub-field code words having N+X bits or code words that are formed from the entries in the sub-field code words of only a sub-group of sub-fields from the plurality of sub-fields instead of the video data words having N bits for the respective colour components.

* * * * *